United States Patent [19]

McKeefry

[11] 3,972,520

[45] Aug. 3, 1976

[54] APPARATUS FOR HANDLING BUSINESS FORMS

[75] Inventor: Jerry L. McKeefry, Pulaski, Wis.

[73] Assignee: Paper Converting Machine Company, Green Bay, Wis.

[22] Filed: Aug. 15, 1975

[21] Appl. No.: 605,147

[52] U.S. Cl. ..... 270/52.5; 270/61 F

[51] Int. Cl.[2] ..... B65H 41/00

[58] Field of Search ..... 270/52.5, 52, 61 F, 270/10, 43

[56] References Cited

UNITED STATES PATENTS

| | | | |
|---|---|---|---|
| 2,280,224 | 4/1942 | Euth | 270/52.5 |
| 2,975,989 | 3/1961 | Hinman | 270/52.5 |
| 3,283,874 | 11/1966 | Goreham | 270/52.5 |

*Primary Examiner*—Edgar S. Burr
*Assistant Examiner*—A. Heinz
*Attorney, Agent, or Firm*—Dawson, Tilton, Fallon & Lungmus

[57] ABSTRACT

Apparatus for handling business forms in which at least three superposed continuous business form webs are processed and thereafter separated for individual folding, with certain of the webs being passed around a compound turning bar prior to folding.

3 Claims, 3 Drawing Figures

11
38'
24
27
37
34
32
25
38
35
12
1

24
26
27
28 p'
37
11
15
3
p
3
25
33
12
16

APPARATUS FOR HANDLING BUSINESS FORMS

BACKGROUND AND SUMMARY OF INVENTION:

This invention relates to apparatus for handling business forms, and more particularly, to apparatus which is adapted to zig-zag fold at least three webs separately in side-by-side relation. As such, it constitutes an improvement upon U.S. Pat. No. 3,596,899.

In that patent, a method of producing web units was disclosed wherein at least two webs were superposed for simultaneous processing and thereafter laterally separated for zig-zag folding. The method of this prior patent was an improvement over machines which had both two-wide processing and folding in eliminating the need for greater diameter printing press cylinders, which in turn necessitated additional plates, thereby creating problems of register. The prior art method was also superior to tandem (in line) folders in providing superior control of the webs through the use of a common drive and permitted handling of the resultant stacks by a single person — inasmuch as the stacks were side-by-side rather than something of the order of 15 feet apart.

When it was felt advantageous to utilize the prior art method for a greater number of webs, i.e., at least three webs to be folded side-by-side, it was found that there was a problem of maintaining register in one of the plies so that the significant advantages of side-by-side folding available in two-wide folders could not be achieved in three-wide or four wide folders. This drawback has been overcome through the use of a novel, compound turning bar which is employed to redirect the direction of travel of certain of the webs. In the illustrated embodiment, the compound turning bar employs inner and outer arcuate members which are fixed yet spaced apart to achieve an advantageous separation of the webs which avoids the register and alignment problems previously experienced and makes feasible achievement of the functional and economic advantages of the two-wide folder principle in a folder capable of handling at least three webs.

DETAILED DESCRIPTION

The invention is described in conjunction with an illustrative embodiment, in the accompanying drawing, in which FIG. 1 is a fragmentary perspective view of apparatus embodying the teachings of this invention relative to four webs;

Figure 1:
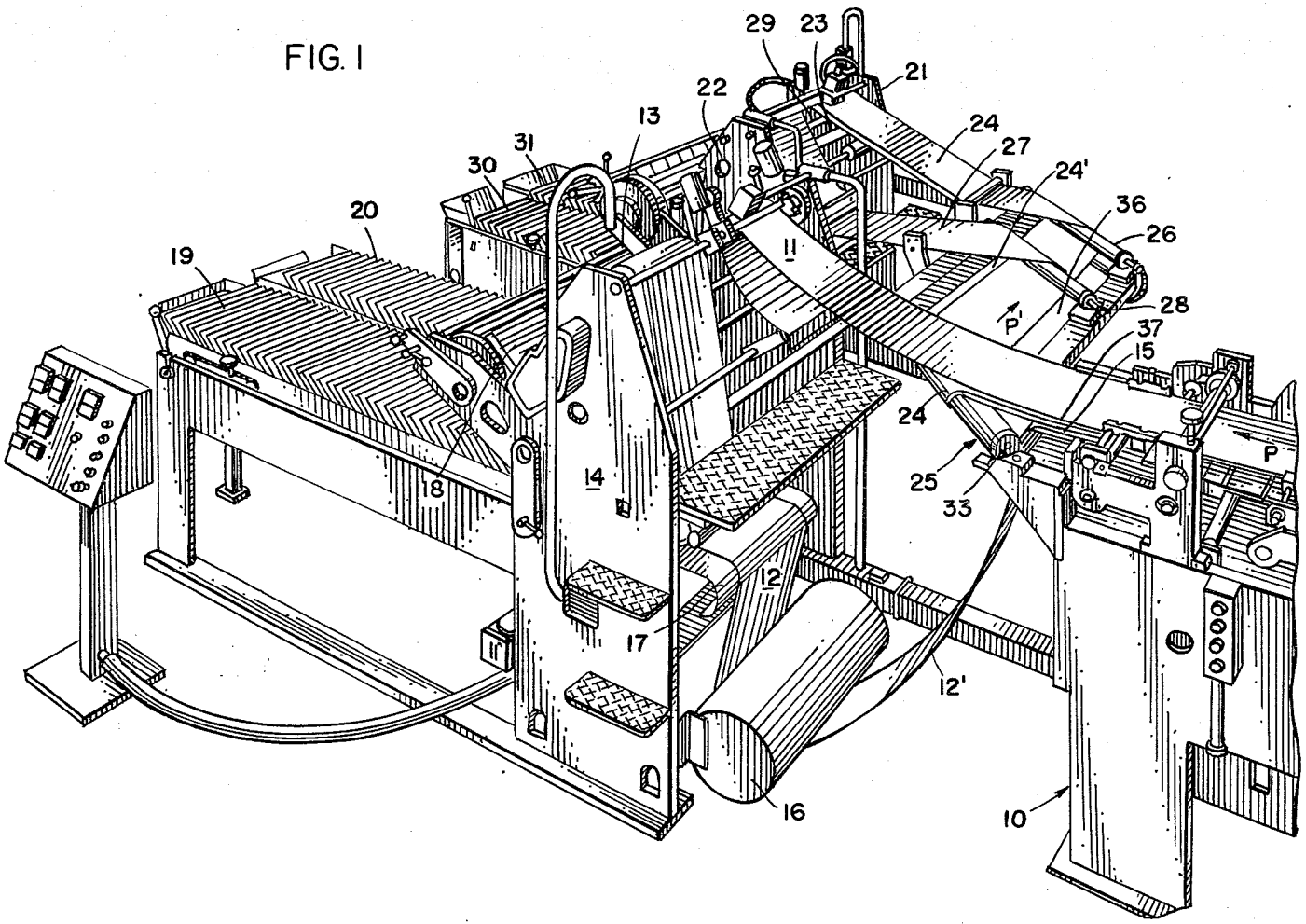

In the illustration given and with reference first to FIG. 1, the numeral 10 designates generally the frame of the machine employed to process a plurality of business form webs simultaneously. The machine may take the form of the machine shown in greater detail in the previously mentioned U.S. Pat. No. 3,596,899 which shows a business form machine having an unwind station from which webs are unwound from parent rolls directed through printing units and thereafter conducted through various processing units such as across perforation, pin hole punching, crash numbering, crimp locking and line-hole punching. Inasmuch as these operations and the structure therefor are well known in the art, the details thereof will be omitted here, it being sufficient to point out that according to the instant invention, the web structure W issuing from the machine frame 10 (having traveled along path P), includes at least three webs which have been processed simultaneously. To show the versatility of the invention, four webs are shown being processed and folded.

These four webs are identified as follows in the drawing (see FIG. 1). The uppermost web unit is designated 11 while the lowermost web unit is designated 12. These two web units are handled in accordance with the prior method set forth in U.S. Pat. No. 3,596,899. In other words, the uppermost web 11 is maintained generally in the path P and proceeds through the right hand folder 13 of a two-wide folder 14. The lowermost web 12 is conducted around a skewed member 15 which permits it to be offset laterally — see the position designated 12' in FIG. 1. Thereafter the web 12 passes around a stationary drum 16 and around a reversely skewed turning bar member 17 so as to travel in a path parallel to but laterally spaced from the path P in which the web 11 is traveling. Thereafter, the web 12 passes through the left hand folder 18 and is delivered in the form of a stack of zig-zag business forms 19 which is seen to be in side-by-side relation with the similar stack 20 resulting from the web 11.

The intermediate pair of webs are ultimately handled by a second two-wide folder 21 (see the upper central portion of FIG. 1). This is essentially identical to the folder 14 — having two folding rolls mounted on a common shaft 22. The right hand folding unit 23 of the two-wide folder 21 handles the upper of the intermediate pair of webs of the web structure W. As can be appreciated from the central right hand portion of FIG. 1, the web second from the top (which is designated 24) passes around a turning unit generally designated 25 and thereby becomes the "under" web when proceeding laterally along the path P'. Thereafter the web 24 encounters a turning bar 26 and is directed along a path parallel to the original path P into the folding unit 23.

The web 27 which is the third from the top in the superposed structure W becomes the "upper" web in traveling along the path P' and it encounters a turning bar 28 which directs it into the left hand folding unit 29 of the folder 21. This results in a stack 30 which is seen to be in side-by-side relation to the stack 31 developed from folding the web 24.

The initial design of the machine where a conventional turning bar was employed in the place of the compound turning bar 25 resulted in malfunctioning of the intermediate pair of web units, primarily the web 27 which was difficult to maintain in register while it was passing through its holding unit 29. It will be appreciated that the folding must be achieved at a precise line across the web, usually defined by a line of cross perforation so that the ultimate user of the business form is able to process the web units through data processing equipment such as a computer printer. For the purpose of maintaining the registration of webs going through folding units, pin belts are normally employed much the same as they are in the main processing machine carried by the frame 10 — when the webs are traveling along the path P. Notably, it was found that the web 27 could be made to engage the pin belt associated with the folder 29 only with extreme difficulty. However, through the utilization of the compound turning bar 25, this difficulty has been avoided and thr four-wide folder can be operated under a variety of conditions without experiencing registration difficulty.

Figures 2, 3:
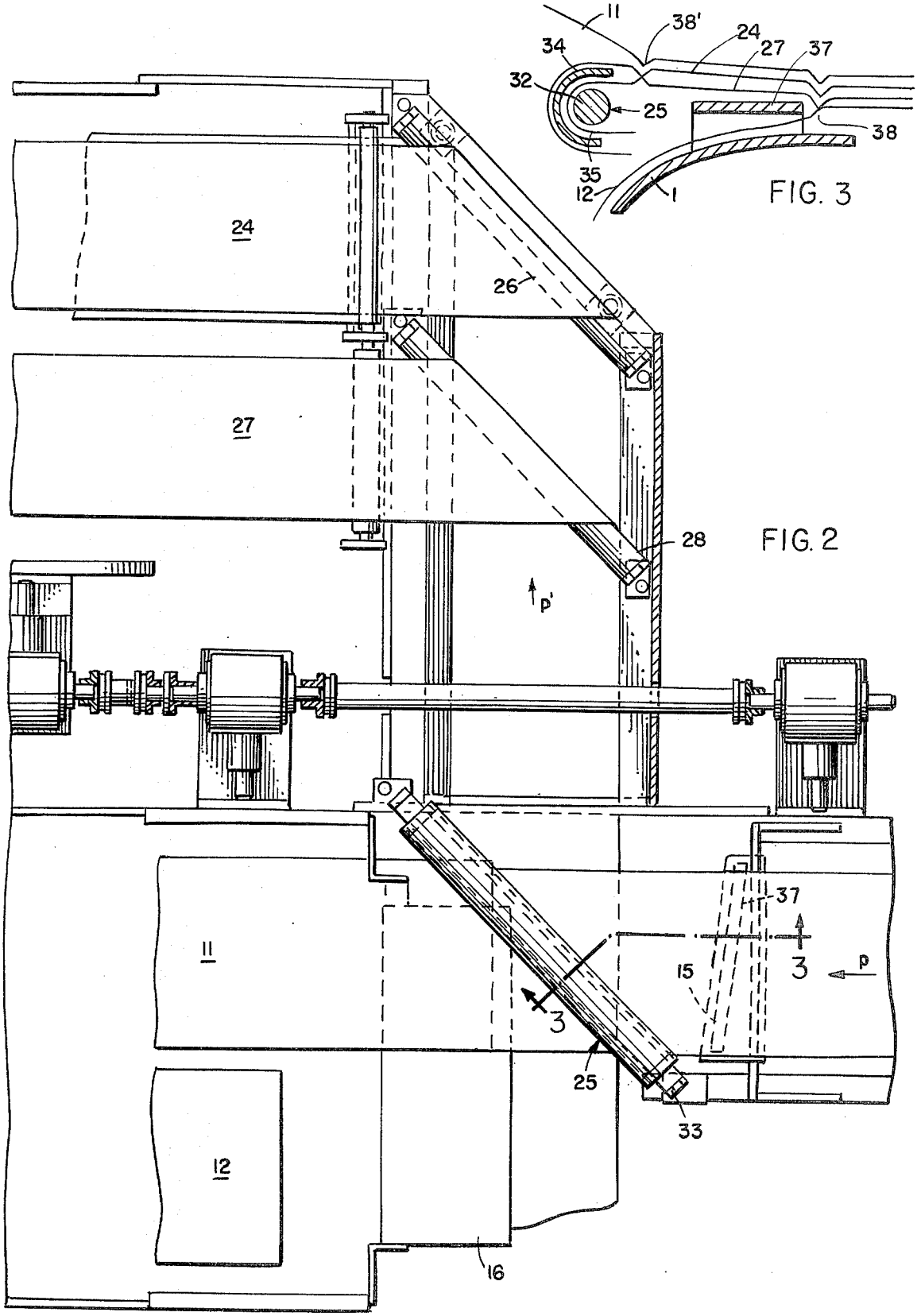
FIG. 2 is a top plan view of the apparatus seen in FIG. 1.
FIG. 3 is a sectional view taken along the sight line 3—3 applied to FIG. 2.

The compound turning bar generally designated 25 can be seen in greater detail in the sectional view of FIG. 3. The compound bar 25 includes an inner tubular member 32 which is fixed on the frame 10 by means of pedestal 33 (see FIGS. 1 and 2). Also as noted schematically in FIG. 3, the web 27 is directed around the member 32 for partial wrapping engagement therewith. Still further as schematically indicated in FIG. 3, the web 24 is directed around another arcuate turning member 34 which is secured at its end to the inner member 32 by means of axially spaced apart collars 35. I have found that the compound turning bar 25 provides a unique and advantageous operation in changing the direction of the movement of webs 27 and 24 and, more particularly, effects an offset of these two webs.

In the central right hand portion of FIG. 1, it will be noted that the web 24 is offset as at 24' (relative to the web 27) in the direction of the folder 21. On the other hand, the use of a single turning bar for both of the webs 24 and 27, i.e., when the webs are directly superimposed, results in the controlling or steering of the web 27 by the web 24 so that the web 27 is not in the most advantageous position for alignment and register with the timing belts associated with the folder 29. Although the mechanism by which the invention operates is imperfectly understood, it is believed that when webs are superposed and directed around a turning bar, the outer web (here the web 24) operates about a slightly larger radius and thus becomes slightly more taut and, in effect, steers or controls the inner web — here the web 27, so as to preclude the web 27 from assuming an equilibrium position best for alignment with the pin belts of the folder 29. This is particularly objectionable with the speeds envisioned — of the order of 1000 feet per minute.

I have found it further advantageous to support both of the webs 27 and 24 during their travel along the path P' and this is achieved through the provision of a support plate 36. Alternatively, an idler or other type roll can be advantageously employed between the compound turning bar 25 and the turning bar 28 to support the webs 24 and 27 which are advantageously maintained under slight tension in the path P'.

OPERATION

In the operation of the invention, at least three webs — four being shown — 11, 12, 24 and 27 make up the web structure W and are processed along a path P which includes a number of processing elements mounted on the frame 10. The uppermost web 11 passes directly into the right hand folder 13 of the two-wide folder 14 and is zig-zag folded to provide a stack 20. The lowermost web 12 is separated laterally and downwardly by means of the skewed member 15 and a second skewed member 17 so as to be aligned with the left hand folder 18 in the two-wide folder 14 — this resulting in the zig-zag folded stack 19, much as shown in U.S. Pat. No. 3,596,899.

The two intermediate webs 24 and 27 are eventually folded by the second two-wide folder 21. Initially, however, the lower one 27 of the intermediate webs is separated from the lowest web 12 by means of a bar or wire member 37. The bar 37 is supported on the skewed member 15 a spaced distance thereabove — see FIG. 3 — and is affective to separate the webs, particularly at the cross perforations 38. The cross perforations tend to weld the various plies together and prevent achievement of the desired equilibrium condition referred to previously. As can be seen in FIG. 2, the bar 37 is skewed (relative to the path of travel P) so as to be parallel with the downstream end of the skewed member 15.

Thereafter, the webs 24 and 27 are separated — particularly at the perforation line 38' — by passing around the arcuate portions 34 and 32 respectively of the compound turning bar 25. It will be appreciated that there is a locking or crimping action attendant to the cross perforation which causes the respective webs or plies to remain together — and I have found that the separation achieved by the compound turning bar 25 is especially advantageous at the speeds contemplated, i.e., 1000 feet per minute. The tendency of the webs to inhere together along the line of cross perforations is represented schematically in FIG. 3 relative to the web 12 at perforation 38 and that relative to the web 11 at the cross perforation 38'.

The compound turning bar 25 is also effective in achieving the beneficial separation of the topmost web 11 and the next underlying web 24 — also as depicted in FIG. 3. The web 11 is drawn along an essentially upward path to assist in the separation but the force for this is applied at the folder 14 while the control over the web 24 is provided by the compound turning bar 25 which is located close to the point of separation.

Although the invention has been described in connection with four superposed webs, it will be appreciated that it has beneficial application to any installation having three or more webs. In such a case, the top web could be handled as shown while the remaining webs controlled through the use of the compound turning bar. In the same fashion, web groupings of more than four plies can be directed into controlled equilibrium by the use of additional compoun d turning bars.

As a specific example of the advantage of the invention, it is possible to add additional folders to an existing line — i.e., a folder 21 can be added to an existing two-wide folder 14 to increase capacity at minimum investment — in money, space and time. In such an instance, it is possible to fun four single webs on a four-part press at speeds of about 1,000 feet per minute — effectively doubling the capacity while still retaining the advantages of single width processing of multiple webs — and further retaining the advantage of having only a single operator to remove the stacks 19, 20, 30 and 31.

I claim:

1. In apparatus for handling business forms, a frame, pin belt means on said frame for advancing along a predetermined linear path at least three superposed continuous business form webs for processing the same, said webs thereby including an uppermost web and at least a pair of webs therebelow, a first folder on said frame linearly aligned with said path and spaced therefrom in the direction of web travel adapted to receive said uppermost web and fold the same, a compound turning bar on said frame in the space between said path and said first folder adapted to receive said pair of said webs and direct the same laterally into a second path generally perpendicularly to the first-mentioned path, said compound turning bar including an elongated inner member extending at an angle to said first-mentioned path and having a generally arcuate periphery when viewed in cross section and an outer member fixed to said inner member but spaced therefrom and having an outer arcuate periphery extending over only a portion of the arcuate periphery of said inner member to provide a leading edge adapted to deleave said pair of webs prior to turning thereof, a turning bar means on said frame in said second path for turning said pair of webs into third and fourth paths generally parallel to said first-mentioned path, and a pair of folders on said frame, one in each of said third and fourth paths each adapted to receive one of said pair of webs.

2. The structure of claim 1 in which said frame is equipped with support means for said pair of webs during the travel thereof in said second path between said compound turning bar and said turning bar means.

3. The structure of claim 1 in which said frame is equipped with further turning means for directing a fourth web positioned below said pair of webs into a fifth path parallel to said third and fourth paths but on the opposite side of said first path from said third and fourth paths, and a folder on said frame in said fifth path.

* * * * *